United States Patent [19]

Simpson

[11] Patent Number: 4,620,483

[45] Date of Patent: Nov. 4, 1986

[54] MISSILE SAFE AND ARM SYSTEM

[75] Inventor: Clarence E. Simpson, Phoenix, Ariz.

[73] Assignee: Unidynamics Phoenix, Inc., Phoenix, Ariz.

[21] Appl. No.: 631,807

[22] Filed: Jul. 17, 1984

[51] Int. Cl.[4] ..... F42C 1/00

[52] U.S. Cl. ..... 102/222; 102/216; 102/267

[58] Field of Search ..... 102/216, 222, 262, 397

[56] References Cited

U.S. PATENT DOCUMENTS

| | | | |
|---|---|---|---|
| 2,889,777 | 6/1959 | Rabinow | 102/216 |
| 3,065,694 | 11/1962 | Plank | 102/222 X |
| 3,858,516 | 1/1975 | Rabinow | 102/262 X |
| 4,176,608 | 12/1979 | Ambrosini et al. | 102/216 |
| 4,240,351 | 12/1980 | Miguel | 102/262 |
| 4,378,740 | 4/1983 | Schneider, Jr. | 102/262 X |
| 4,513,664 | 4/1985 | Edmonds | 102/216 |
| 4,567,829 | 2/1986 | Ziemba et al. | 102/216 X |

*Primary Examiner*—Peter A. Nelson

*Attorney, Agent, or Firm*—Cahill, Sutton & Thomas

[57] ABSTRACT

A missile safe and arm system incorporates an electrically triggered explosive train that extends from the missile body to an extendable probe and back to the missile body. When the probe is in its retracted position, the explosive train, and electrical triggering circuit is interrupted and detonator firing leads are shorted and the missile is in a safe condition. Upon launching and upon the extension of the extendable probe, the explosive train and its electrical triggering circuit become aligned, the detonator shorting lead is removed, and the missile is thus armed.

7 Claims, 8 Drawing Figures

MISSILE SAFE AND ARM SYSTEM

FIELD OF THE INVENTION

The present invention pertains to safe and arming system for incorporation in missiles, and particularly missiles having extendable probes.

DESCRIPTION OF THE PRIOR ART

Missiles, and particularly missiles used for piercing armor, commonly incorporate an explosive charge referred to as a "shaped charge". Such shaped charges are generally cylindrical and include a conical cavity at one end thereof. Upon detonation, the cavity causes the focusing of the flame front of the explosion and enables the charge to burn through significant thicknesses of armor. To insure the concentration of the flaming gas front on the armor, it is usually necessary to insure that the charge is detonated at a prescribed distance from the surface that it is to penetrate. This distance, commonly referred to as the standoff distance, may be determined by the use of extendable probes.

Typically, a missile having such entendable probes will be stored with the probes telescoped within the body of the missile so that such probes are not damaged during handling or the sensative tips of the probes, which may contain impact responsive contacts, struck or deformed. The use of such extendable probes also result in missiles that are substantially more compact than if such probes were permanently extended.

It is obviously important to provide an effective safe system such that the missile may be handled under rough field conditions without the danger of accidental detonation. Similarly, any such safe system must also provide a means for conveniently arming the missile so that it may be used for its intended purpose. There are presently numerous techniques for arming such missiles; however, to render such systems foolproof, while nevertheless retaining reliability, has customarily entailed substantial complexity and cost.

OBJECTS OF THE INVENTION

It is therefore an object of the present invention to provide an improved safe and arming system for a missile having an extendable probe.

It is another object of the present invention to provide a safe and arming system that is simple and reliable while nevertheless providing absolute safety when in the safe condition.

It is still another object of the present invention to provide a safe and arming system incorporating an explosive train that is interrupted at all times except when the missile is armed.

It is still another object of the present invention to provide a safe and arming system incorporating an explosive train and an electrical triggering circuit that is interrupted at all times except when the missile is armed.

It is still another object of the present invention to provide a safe and arming system incorporating an explosive train and electrical triggering circuit that is interrupted at all times with the detonator firing leads shorted except when the missile is armed.

These and other objects of the present invention will become apparent to those skilled in the art as the description thereof proceeds.

SUMMARY OF THE INVENTION

A missile, of the shaped charged variety, incorporates an extendable probe that remains in a telescoped collapsed position during transportation and handling. The probe tip includes a pair of electrical contacts for completing an electrical circuit. When the probe is in its stowed position, it is important to insure the safety of the missile and prevent inadvertant ignition even though the electrical contacts may be closed by accident during handling. Further, to insure that a stray electrical current or pulse does not cause premature or accidental detonation, the present invention utilizes an explosive train; the only means for detonating the explosive charge carried by the missile is through the explosive train.

The resulting electrical impulse caused by the closure of the electrical contacts energizes an electrical initiator which ignites the explosive train; however, when the probe is in its stowed or stored position, the explosive train and the electrical triggering circuit are interrupted and thus preventing the main charge from igniting. Additional safety against inadvertent firing is provided by shorting the electrical initiator firing leads in the stowed position. The interrupted explosive train is provided by an explosive train path beginning at the ogive of the missile, to the extended probe, and back to the missile body; when the probe is not extended, that portion of the explosive train contained therein is not appropriately aligned with the remaining explosive train. Therefore, the explosive train is incomplete or interrupted resulting in the prevention of inadvertant detonation of the main charge of the missile. The triggering circuit includes an electrical path that remains interrupted until the probe is extended, thus providing double safety in the event of an accidental closure of the electrical contacts.

DETAILED DESCRIPTION OF THE PREFERRED EMBODIMENT

Figure 1:
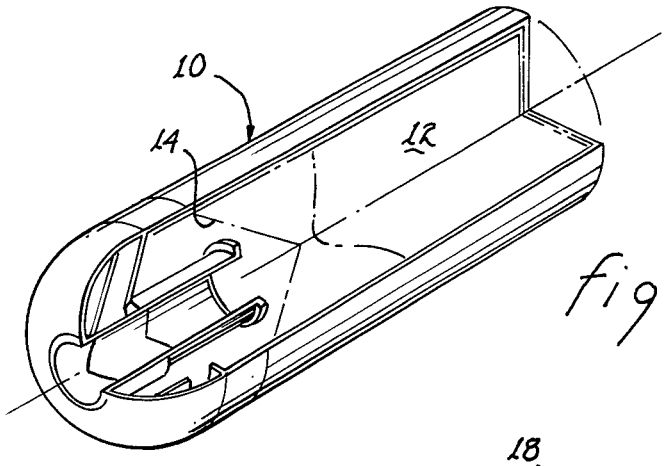
FIG. 1 is an isometric view of a missile incorporating the teachings of the present invention showing the extendable probe in the stowed or safe position.
Figure 2:
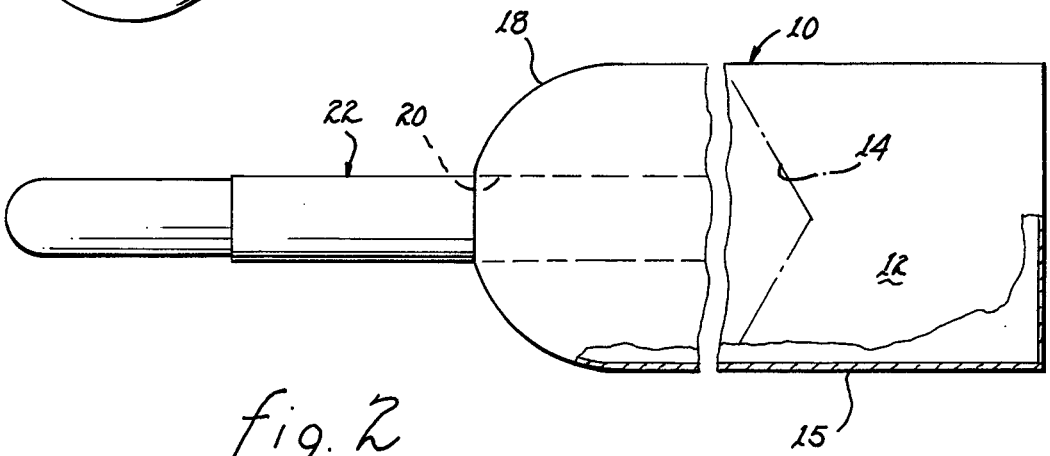
FIG. 2 is an isometric view of the missile of FIG. 1 showing the probe in the extended or armed position.

Referring now to FIGS. 1 and 2, it may be seen that the missile body 10 includes within it a main charge of explosive 12 that may include a conically shaped cavity 14 at one end thereof in accordance with well-known principles to achieve penetration from the exploding and burning gases. The main charge 12 is detonated by an explosive train 15 that interconnects with the main charge at the rear portion 16 thereof. The missile 10 includes an ogive 18 that terminates at its central portion with an opening 20 to permit the extension of a probe 22. The probe is shown telescoped into its stowed or safe position in FIG. 1, and is shown in its extended or armed postion in FIG. 2.

Figure 3:
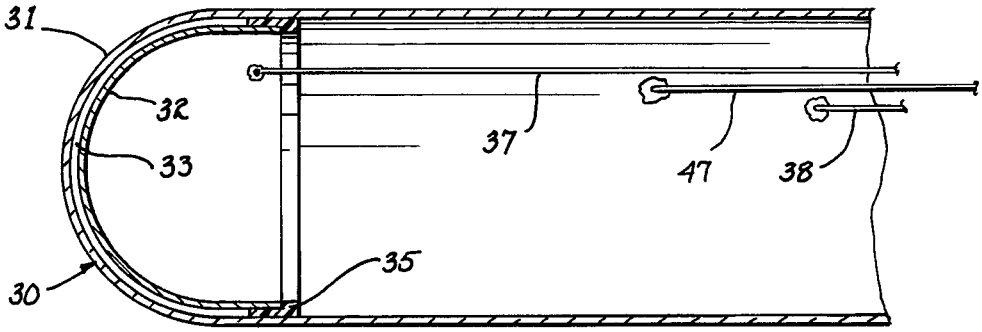
FIG. 3 is a cross sectional view of a portion of the missile of FIG. 1 useful for describing the apparatus of the present invention.
Figure 7:
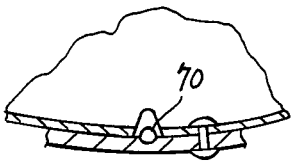
FIG. 7 is a sectional view of a portion of FIG. 4 taken along lines 6—6.
Figure 4:
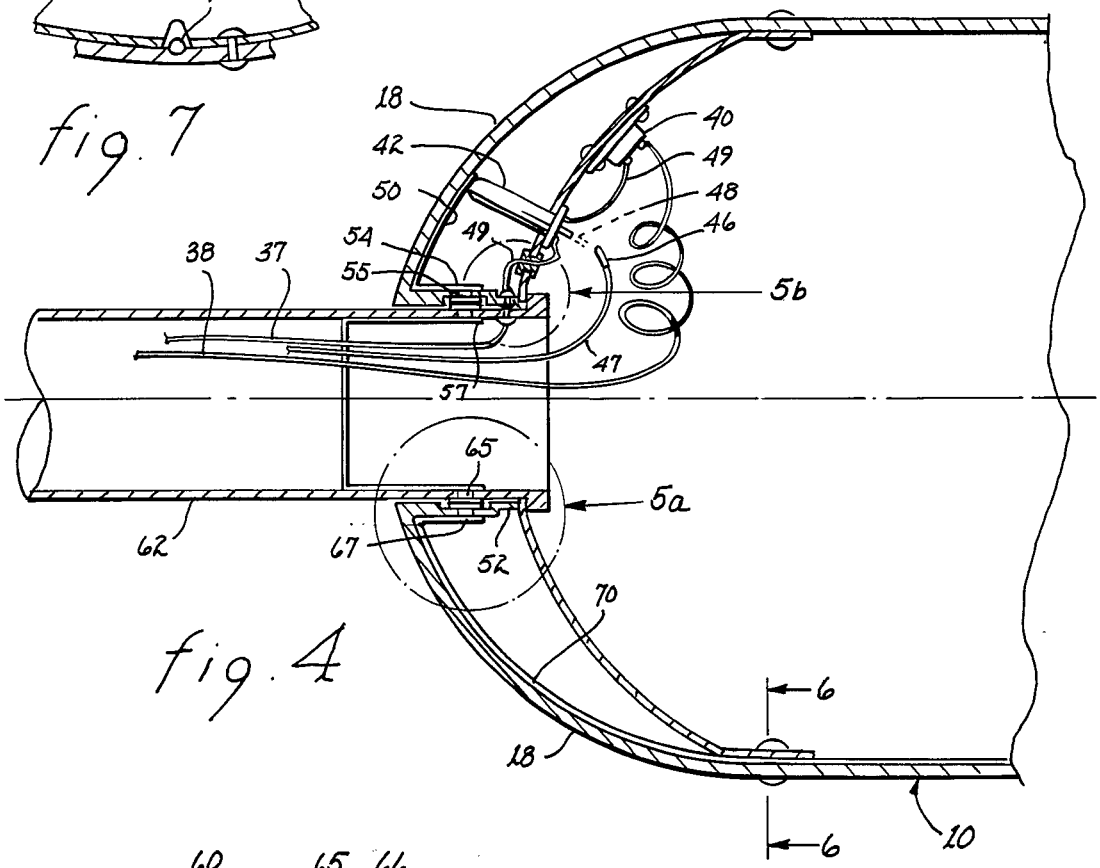

Referring now to FIGS. 3, 4 and 5, it may be seen that the probe includes a tip 30 that includes an impact responsive means such as a pair of contacts 31 and 32 separated by an air gap 33. Upon impact, contact 31 is deformed and forced into contact with contact 32 thus completing an electrical circuit. The contacts are separated by an insulating separator 35 and are connected into an electrical circuit (to be described) by electrical conductors 37 and 38 appropriately fastened to the respective contacts. It will be understood to those skilled in the art that the deformed tip of the probe as shown in FIG. 3 may take a variety of forms, the specific embodiment shown in FIG. 3 being taken for convenience and simplicity.

Electrical conductors 37 and 38 are connected through a suitable power source 40 to an electric explosive initiator 42. The power source 40 may take any of a variety of forms and is commonly referred to as an onboard power source. The electrical power may be provided by storage batteries, charged capacitors, or any of a variety of presently available techniques for providing electrical power.

Figure 5A:
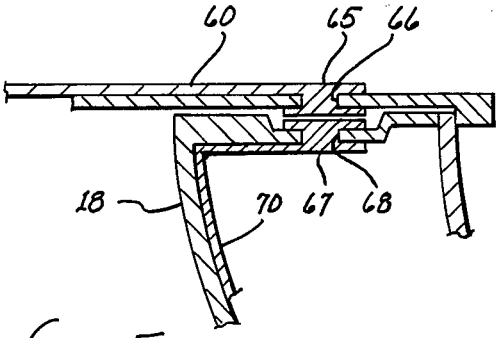
FIG. 5*a* is an enlarged view of a portion of FIG. 4.
Figure 5B:
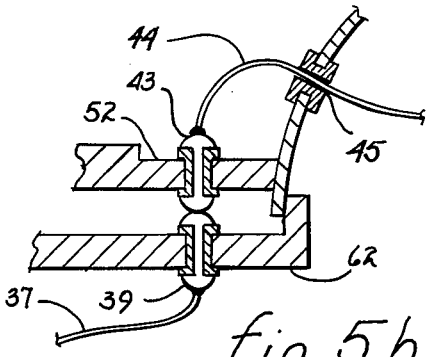
FIG. 5*b* is an enlarged view of another portion of FIG. 4.

It may be seen that electrical conductor 37 is secured to contact 39 that passes the wall of probe section 62 and abuts opposing contact 43. Conductor 44 is connected to contact 43 and passes through opening 45 and is secured to initiator 42. When probe section 62 is extended, as shown in FIGS. 4, 5*a* and 5*b*, the contacts 39 and 43 are in abutting contact so they provide a continuous electrical path to the initiator from conductor 37. If the probe section 62 is not fully extended, the contacts 39 and 43 will not be aligned and in abuttment with each other, thereby interrupting the electrical circuit to the initiator.

A shorting plug 46 is provided to short circuit the conductors 49 to thus insure that any stray current that may be induced therein is short circuited around the initiator 42. Thus, even in the presence of a strong electromagnetic field, no current is permitted to flow through the initiator 42. When the probe is extended, the cable 47, attached to the probe and to the plug 46, pulls the shorting plug from its safe position shown in broken lines at 48 to thereby permit any electrical current in conductors 49 to flow through the initiator 42.

The initiator 42 responds to the receipt of an electrical signal from the power source 40, as a result of the closure of the contacts 31 and 32, by initiating the explosive train. It may be seen that the explosive train is formed in three parts, the first portion 50 extends from the initiator adjacent the inner surface of the ogive 18 and terminates at a flange 52 extending inwardly therefrom. The first portion terminates at an explosive pad 54 which extends through a small opening 55 in the flange 52. The pad 54 is typically made of the same material as the explosive train and merely provides a convenient means for extending the explosive train through an opening in a supporting surface such as the flange 52, and further provides a means for permitting the explosive train to jump or bridge a gap from one explosive pad to a closely positioned adjacent explosive pad.

In the embodiment chosen for illustration, a second explosive pad 57 is shown positioned immediately adjacent the pad 54 such that the opposing surface areas are aligned. The pad 57 forms the initial part of the second portion 60 of the explosive train. It may be noted that the portion 60 of the explosive train is within the probe section 62 and is not mechanically connected in any way to missile body 10. The progression of the explosive wave upon ignition of the explosive train travels from the initiator 42 through the first portion 50 of the explosive train, through the opposing explosive pads 55 and 57, and subsequently through the second portion 60 of the explosive train.

The second portion 60 of the explosive train terminates in explosive pad 65 which extends through an opening 66 in the probe 62. The pad 65 is positioned opposite pad 67 which in turn is mounted on the flange 52 of the missile body and extends through an opening 68 provided therein for the pad 67. The pad 67 forms one end of the third position 70 of the explosive train which will provide the necessary detonation energy for the main charge 12 in the body of the missile.

It may be seen that when the probe is in its stowed or safe position, the portion 60 of the explosive train will not be in the position shown in FIG. 4, but rather will be located in the stowed probe position somewhere inside the body of the missile. Therefore, in the event that the explosive train was initiated by some external means, the explosive train would terminate at the pad 54 and no detonating energy would be delivered to the main charge.

In operation, when the probe is in its stowed position, the explosive train and initiating or triggering circuits are interrupted and the detonator ignition element is shorted; thus, it is virtually impossible for an inadvertant initiation of the explosive train to detonate the main charge. When the missile is fired, the probe is extended by convential means (not shown). Typically, probes can be extended through utilization of compressed air or mechanical springs or variations thereof. In some instances, small explosive devices may be used to extend the probe. When the probe is extended, the portion 60 of the explosive pads 57 and 65 at either end thereof become aligned with explosive pads 54 and 67 respectively. The portions 50,60 and 70 of the explosive train are now aligned and actuation of the initiator 42 will result in detonation energy traversing the entire length of the explosive train to the main charge. Further, electrical contacts 39 and 43 are now in abutting contact to permit completion of the electrical circuit from the power source 40, through contacts 31 and 32, to initiator 42, while the shorting plug 46 has been pulled from the initiator to allow current to flow to the initiator.

Figure 6:
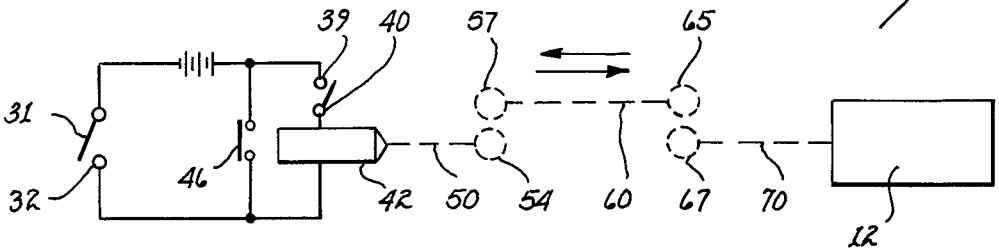
FIG. 6 is a schematic diagram showing an electrical circuit and an explosive train arranged in accordance with the teachings of the present invention.

The operation of the safe and arm system of the present invention may conveniently be shown by reference to the schematic drawing of FIG. 6 wherein it may be seen that the closure of contacts 31 and 32 will result in the generation of a detonation signal, only if contacts 39 and 43 are closed and the shorting plug 46 is removed, to the electric explosive initiator 42. The energization of the initiator 42 energizes portion 50 of the explosive train which portion terminates at pad 54. If the probe is appropriately extended and is in the armed position, the pad 54 will be aligned with the explosive pad 57 providing continuity of the explosive train. Similarly, the portion 60 of the explosive train will terminate with pad 65 which in turn will be aligned with explosive pad 67 to permit continuation of the explosive train through portion 70 to the main charge 12. It may be seen that unless the probe is extended, the explosive train will be interrupted and energization of the initiator 42 will not result in the detonation of the main charge 12.

The explosive train may be deposited or positioned in any convenient manner such as by extruding or applying a slurry to the appropriate surfaces. Further, it will be apparent to those skilled in the art that the explosive train may be positioned within grooves provided therefor in supporting surfaces such as the inner surface of the ogive 18 and the inner surface of the probe 62. It will also be apparent to those skilled in the art that the conductors 37,38 and 44 may take other forms such as a strip conductor secured to an insulating strip adhering to the inner surface of the probe. In the event multiple probe sections are used in the missile, it may also be appropriate to incorporate pairs of abutting contacts at the overlapping portion of adjacent probe sections to prevent initiation if all probe sections are not fully extended.

We claim:

1. In an explosive missile having a missile body and having an extendable probe, an arm and safe system comprising:

a. impact responsive means mounted in said probe for generating a detonation signal;

b. initiator means mounted in said body responsive to said signal for initiating an explosive train;

c. an explosive charge mounted in said missile body;

d. a first explosive train, positioned in said missile body, extending from said initiator and terminating at a first termination point positioned in said missile adjacent said probe;

e. a second explosive train, positioned in said probe, extending from adjacent said first terminal point of said first explosive train, when said probe is extended, to a second termination point; said second explosive train being misaligned with said first termination point when said probe is not extended.

f. a third explosive train, positioned in said missile body, extending from adjacent said second termination point, when said probe is extended, to said explosive charge.

whereby said explosive charge may be detonated only when said probe is extended.

2. The combination set forth in claim 1 wherein said impact responsive means comprises electrical contacts positioned in said probe for completing an electrical circuit to energize said initiator means.

3. In an explosive missile having a probe extendable from the missile body, a safe and arm system comprising:

an explosive train extending from said missile body to said probe and back to said missile body, a portion of said explosive train positioned on said probe and being misaligned with remainder of said explosive train when said probe is not extended, and aligned with remainder of said explosive train when said probe is extended.

whereby said explosive train is interrupted when said probe is not extended to prevent detonation of said missile.

4. In an explosive missile having a probe extendable from the missile body, a safe and arm system comprising:

an explosive train extending from said missile body to said probe and back to said missile body, a portion of said explosive train positioned on said probe and being misaligned with remainder of said explosive train when said probe is not extended, and aligned with remainder of said explosive train when said probe is extended; an electrical initiation circuit including conducting means extending from said missile body to said probe, said conducting means including first contact on said missile body in contact with a second contact on said probe when said probe is extended and not in contact with said second contact when said probe is not extended.

whereby said explosive train and said electrical circuit are interrupted when said probe is not extended to prevent detonation of said missile.

5. In an explosive missile having a missile body and having an extendable probe, an arm and safe system comprising:

a. impact responsive means mounted in said probe for completing an electrical circuit to generate a detonation signal;

b. initiator means mounted in said body responsive to said signal for initiating an explosive train;

c. an explosive charge mounted in said missile body;

d. a first explosive train, positioned in said missile body, extending from said initiator and terminating at a first termination point positioned in said missile adjacent said probe;

f. a third explosive train, positioned in said missile body, extending from adjacent said second termination point, when said probe is extended, to said explosive charge;

g. said electrical circuit including opposing contacts positioned on said missile body and probe respectively, said contacts being in contact with each other to provide a continuous circuit path when said probe is extended and not being in contact with each other when said probe is not extended;

whereby said explosive charge may be detonated only when said probe is extended.

6. In an explosive missile having a missile body and having an extendable probe, an arm and safe system comprising:

a. impact responsive means mounted in said probe for generating a detonation signal;

b. initiator means mounted in said body responsive to said signal for initiating an explosive train;

c. an explosive charge mounted in said missile body;

d. a power source mounted in said missile body and electrically connected to said impact responsive means and to said initiator for transmitting said detonation signal;

e. electric circuit interruption means for interruting the circuit between said impact responsive means and said initiator comprising;

1. a pair of contacts, one mounted on said missile body and connected to said initiator, and another mounted in said probe and connected to said impact responsive means;

2. said contacts abutting each other only when said probes are extended to thereby complete an electrical circuit and permit the transmission of said detonation signal.

7. The combination set forth in claim 1 including;

a. a power source mounted in said missile body and electrically connected to said impact responsive means and to said iniator;

b. electric circuit interruption means for interrupting the circuit between said impact responsive means and said initiator comprising;

1. a pair of contacts, one mounted on said missile body and connected to said initiator, and another mounted in said probe and connected to said impact responsive means;

2. said contacts abutting each other only when said probes are extended to thereby complete an electrical circuit and permit the transmission of said detonation signal.

* * * * *